US008457870B2

(12) United States Patent
Gassner

(10) Patent No.: US 8,457,870 B2
(45) Date of Patent: Jun. 4, 2013

(54) METHOD FOR THE OPERATION OF A DRIVER ASSISTANCE SYSTEM OF A VEHICLE

(75) Inventor: Markus Gassner, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 290 days.

(21) Appl. No.: 12/752,510

(22) Filed: Apr. 1, 2010

(65) Prior Publication Data

US 2010/0256898 A1 Oct. 7, 2010

(30) Foreign Application Priority Data

Apr. 2, 2009 (DE) ..... 10 2009 016 055

(51) Int. Cl.
*G08G 1/00* (2006.01)

(52) U.S. Cl.
USPC ..... 701/117

(58) Field of Classification Search
USPC ..... 701/117
See application file for complete search history.

(56) References Cited

U.S. PATENT DOCUMENTS 6,012,012 A 1/2000 Fleck et al.
6,047,234 A 4/2000 Cherveny et al.
2005/0096839 A1* 5/2005 Nakano et al. ..... 701/200
2007/0225894 A1 9/2007 Tsukamoto
2012/0008708 A1* 1/2012 Kim et al. ..... 375/295

FOREIGN PATENT DOCUMENTS

DE 196 04 084 A1 10/1996
WO 2007/032576 A1 * 3/2007
WO WO 2007/032576 A1 3/2007

OTHER PUBLICATIONS

German Search Report dated Oct. 2, 2009 with English translation (nine (9) pages).

* cited by examiner

*Primary Examiner* — Thomas Tarcza
*Assistant Examiner* — Maceeh Anwari
(74) *Attorney, Agent, or Firm* — Crowell & Moring LLP

(57) ABSTRACT

A method for the operation of a driver assistance system of a vehicle (C1, C2), particularly of a motor vehicle and/or a commercial vehicle is provided. A message produced by a central computer (ZR), the message having traffic data (VD) and a confidence parameter (CL) which represents a measure for the reliability of the traffic data (VD) is received by a computer (R1, R2) of the vehicle (C1, C2). According to the magnitude of the confidence parameter, the transmission of a traffic status message (VZD), having at least one time stamp as well as coordinates of the vehicle (C1, C2), is directed to the central computer.

18 Claims, 2 Drawing Sheets

METHOD FOR THE OPERATION OF A DRIVER ASSISTANCE SYSTEM OF A VEHICLE

CROSS REFERENCE TO RELATED APPLICATIONS

This application claims priority under 35 U.S.C. §119 to German Patent Application No. DE 102009016055.8, filed Apr. 2, 2009, the entire disclosures of which are herein expressly incorporated by reference.

BACKGROUND AND SUMMARY OF THE INVENTION

The invention relates to a method for the operation of a driver assistance system of a vehicle, particularly of a motor vehicle and/or a commercial vehicle. The invention also relates to a method for the operation of a communication infrastructure for detecting and producing road traffic data. The invention also relates to a computer of a driver assistance system in a vehicle.

Data which is generated by a vehicle which is actively participating in traffic activity is called floating car data (FCD). Participation by a vehicle in traffic activity includes both the state of driving as well as the state of being stopped, e.g. in a traffic jam, at a light, or in a waiting area. The traffic status message sent by the vehicle to a central computer of at least one communication infrastructure contains at least one time stamp as well as coordinates of the vehicle. The central computer, which is typically managed by an electronic data transmission service provider, receives the preferably anonymized traffic status message from the vehicle. In combination with data from stationary sensors, information contained in the traffic status message is used to deduce a status of traffic activity on certain road segments or in certain traffic segments. A message which describes and/or represents the traffic status, the message optionally also containing information regarding potential deviation opportunities, is transmitted by the central computer to the vehicles. Computers in the vehicles check the received data for plausibility. This means that the computers check the current location utilizing the coordinates thereof and also check a selected route. By using the information contained in the message, the vehicles can compute a route which is suitable for them and which incorporates details of the current traffic activity.

A further development of the floating car data concept is that of extended floating car data (XFCD), wherein additional data from assistance systems built into the car, for example ABS, ASR, ESP, or rain sensors, are incorporated by a computer of a vehicle to determine the content of the traffic status message. XFCD recognizes, for example using ABS and ESP data, that a stretch of road just negotiated has black ice.

In the case of existing or planned communication infrastructures for detecting and producing road traffic data, a traffic status message is transmitted to the central computer if an event is detected by the vehicle, for example the beginning or the end of a traffic jam. The traffic status messages are typically transmitted to the central computer via a mobile communications channel, wherein each transmission of a traffic status message entails costs for the service provider. For this reason, transmission of a traffic status message is discontinued or suppressed as soon as the vehicle receives a message from the central computer of the service provider for the detected event. Until the message about a particular traffic event produced by the central computer is broadcast, all vehicles detecting the traffic event transmit a traffic status message to the central computer. Therefore, for one particular event, in principle a large number of traffic status messages are transmitted to the central computer, resulting in high costs. Because it is to be expected that in the future an increasingly larger number of vehicles will be equipped for transmitting traffic status messages, significant costs are expected to accrue to the service provider.

For this reason, the problem addressed by the present invention is that of providing a method for the operation of a driver assistance system in a vehicle, the method enabling a more cost-effective provision of an electronic data transmission service.

An additional problem addressed by the present invention is that of providing a method for the operation of a communications infrastructure for detecting and producing road traffic data, the method requiring minimal cost inputs while offering high precision.

An additional problem addressed by the invention is that of providing a computer of a driver assistance system in a vehicle which enables the cost-effective operation of a communication infrastructure for detecting and producing road traffic data.

These problems are addressed by exemplary embodiments of the invention including a method for the operation of a driver assistance system, a method for the operation of a communication infrastructure, and a computer of a driver assistance system.

In a first embodiment, the invention creates a method for the operation of a driver assistance system of a vehicle, particularly of a motor vehicle and/or a commercial vehicle. According to this method, a message produced by a central computer is received by a computer of the vehicle, the message having traffic data as well as a confidence parameter which represents a measure for the reliability of the traffic data. The traffic data contained in the message produced by the central computer has a time point for the message, coordinates defining a certain stretch of road, and additional information. Using this data, the vehicle computer can determine whether the traffic event described in the message lies on a route which is relevant for the vehicle. According to the magnitude of the confidence parameter, the transmission of a traffic status message is directed to the central computer, the message having at least one time stamp and also coordinates of the vehicle.

Evaluation of the confidence parameter contained in the message makes it possible for the vehicle computer to decide whether the transmission of a traffic status message to the central computer, the message relating to a detected traffic event, needs to be carried out or not. By means of the confidence parameter, the central computer of a communication infrastructure can control whether it would like to receive additional traffic status messages for a particular traffic event from traffic participants, i.e. vehicles. If the certainty regarding a detected traffic event is sufficiently large, the central computer can then signal by means of a corresponding confidence parameter that it does not need any further information about this particular event. This means that the central computer is sufficiently 'sure' with respect to the reliability of the particular traffic event. On the other hand, if additional information is needed by the central computer for the verification of the traffic event, additional traffic status messages can be indirectly "requested" by means of the suitable confidence parameter. The result is that the number of traffic status messages for particular traffic events can be significantly reduced, whereby the costs associated with the provision of the service, compared to the prior art, can also be decreased.

In one embodiment of the method according to the invention, the vehicle computer checks whether the confidence parameter contained in the message exceeds a prespecified threshold value. If the confidence parameter exceeds the prespecified threshold value, transmission of the traffic status message to the central computer is then suppressed. In contrast, if the confidence parameter lies below the prespecified threshold value, the traffic status message is transmitted to the central computer.

In this context, it is reasonable that the traffic data contained in the message is compared by the vehicle computer to traffic data detected by the vehicle computer, and if a difference is determined, the traffic status message is transmitted to the central computer whether or not the confidence parameter exceeds the prespecified threshold value. The determination of a difference between the traffic data contained in the message and the traffic data detected by the vehicle computer need not be carried out only with respect to a difference in the mathematical sense. This process should be understood much more as the detection of a qualitative difference. Such a qualitative difference is considered to exist when, for example, the traffic data contained in the message of the central computer represents a traffic jam for a particular road segment when no such traffic jam (i.e. a stopping state of the vehicle) can be detected by the moving vehicle in the same road segment. In this case, a traffic status message is transmitted to the central computer regardless of the magnitude of the confidence parameter, such that the central computer can broadcast an updated and corrected message for the relevant road segment.

The technology used for the transmission of the message by the central computer to the vehicle computer, as well as the technology used for the transmission of the traffic status message from the vehicle computer to the central computer, are in principle insignificant for carrying out the method according to the invention. In one embodiment, the message sent by the central computer is received by a vehicle receiver unit designed to receive broadcast messages. In another embodiment, the message sent by the central computer is received by a vehicle receiver unit designed to receive mobile communication messages.

In this case, for example the GSM (Global System for Mobile Communications), UMTS (Universal Mobile Telecommunications Standard) or the GPRS (General Packet Radio Service) standard can be used.

It is further reasonable that the message sent by the central computer is constructed according to a protocol of the TPEG TAP standard (Transport Protocol Experts Group and/or TPEG Automotive Profile). This standard already includes a field for the confidence parameter, which can be used for the method according to the invention. This field is termed "Confidence level". It is originally intended to give assistance in decision making to a vehicle computer for route planning, regarding when re-planning of the route should be undertaken when a traffic event is detected and reported. For this purpose, this field also represents a parameter which represents a measure for the reliability of the traffic data. However, such a threshold value for modifying the route planning must of course be selected in a different manner from a threshold value for carrying out the method according to the invention.

Particularly, the threshold value lies above an additional threshold value for the confidence parameter if the additional threshold value is used for deciding whether a modification must be undertaken for the route planning determined for the vehicle. It is reasonable that the threshold value is greater than 70%, particularly greater than 75%, and preferably greater than 80%. The threshold value can consequently assume any value between 0 and 1 and/or 0% and 100%. It is also reasonable to design the confidence parameter in the form of a (digital) flag with two values in order to control suppression or transmission of the traffic status message to the central computer.

The invention further comprises a computer program product which can be loaded directly into the internal memory of a digital computer of a vehicle, and which has software code segments which carry out the steps of the described method when the product is running on the vehicle computer.

In a second embodiment, the invention creates a method for the operation of a communication infrastructure for detecting and producing road traffic data.

According to this method, a traffic status message containing at least one time stamp and also coordinates of the vehicle is sent to a central computer by at least one vehicle participating in traffic activity, the message being sent in prespecified intervals and/or upon the appearance of a detected, prespecified event. From the received traffic status messages, the central computer produces a message which has the traffic data and also a confidence parameter which represents a measure for the reliability of the traffic data, and transmits said message to the at least one vehicle. The message produced by the central computer, containing the traffic data and the confidence parameter, is received by a computer of the at least one vehicle. Depending on the magnitude of the confidence parameter, the transmission of an additional traffic status message is directed by the at least one vehicle to the central computer.

In this way, transmission of traffic status messages can be prevented for events which have already been detected with certainty. And as such, costs for the operation of the communication infrastructure can be reduced.

In one embodiment of the method, the computer of a vehicle checks whether the confidence parameter contained in the message exceeds a prespecified threshold value. Transmission of the traffic status message to the central computer is then suppressed if the confidence parameter exceeds the prespecified threshold value. In contrast, the traffic status message is transmitted to the central computer if the confidence parameter is less than the threshold value.

According to an additional embodiment, the traffic data contained in the message is compared by the vehicle computer to traffic data detected by the vehicle computer, and if a difference is determined, the traffic status message is transmitted to the central computer, whether or not the confidence parameter exceeds the prespecified threshold value.

The central computer then broadcasts the message, in the broadcast method, or transmits the same as a dedicated mobile communications message to the at least one vehicle. The transmission can, as described above, be carried out according to the GMS, UMTS, or GPRS standard, for example.

It is reasonable that the central computer transmits the message according to a protocol of the TPEG TAP standard, because this standard already includes a field for the confidence parameter which can be used according to the invention.

In addition, the invention provides that the central computer transmits the message in periodic intervals to the at least one vehicle, and the confidence parameter is adjusted each time to the reliability of the traffic data.

For the determination of the confidence parameter, the central computer does not necessarily have to rely solely on the information received in the traffic status message of the at least one vehicle. The central computer can also incorporate data from sensors (e.g. cameras and induction coils) arranged in stationary positions along a certain segment of traffic into the result of the traffic data and into the confidence parameter. If such a stationary infrastructure is developed and constructed to useful proportions, it may be optionally unnecessary to include traffic status messages from vehicles for a particular road segment. Also by means of this combination, costs can be saved for the traffic status messages.

Finally, the invention comprises a computer of a driver assistance system in a vehicle, particularly in a motor vehicle and/or a commercial vehicle. The computer has a receiving unit for receiving a message produced by a central computer, the message having traffic data and a confidence parameter which represents a measure for the reliability of the traffic data. The computer also has a control unit for directing the transmission of a traffic status message, having at least one time stamp as well as coordinates of the vehicle, to the central computer according to a magnitude of the confidence parameter.

Moreover, the computer is designed to carry out the described method. A computer according to the invention has the same advantages as the method described above.

Other objects, advantages and novel features of the present invention will become apparent from the following detailed description of one or more preferred embodiments when considered in conjunction with the accompanying drawings.

BRIEF DESCRIPTION OF THE DRAWINGS

The invention is described in closer detail using one embodiment in the following drawings. The drawings show.

DETAILED DESCRIPTION OF THE DRAWINGS

Figure 1:
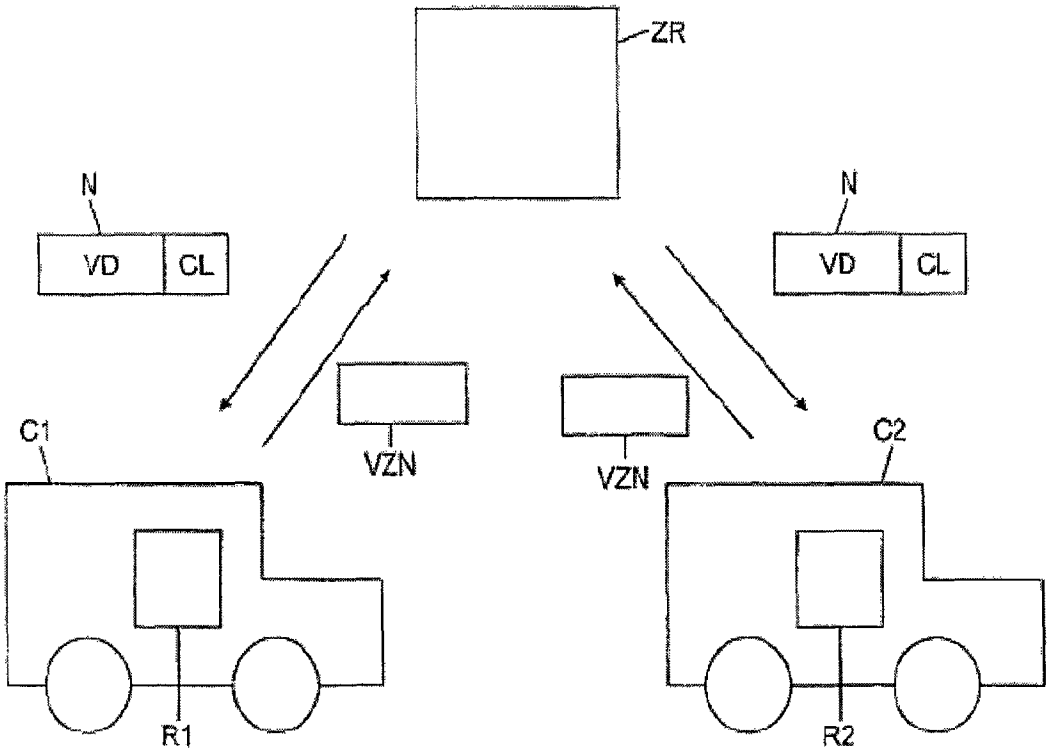
FIG. 1 a schematic illustration of a problem addressed by the method according to the invention, and FIG. 2 a schematic process flow of the method according to the invention.

FIG. 1 shows a schematic illustration of the problem addressed by the method according to the invention. A communication infrastructure for detecting and producing road traffic data has a central computer ZR which is typically managed by an electronic data transmission service provider. The central computer ZR is connected to and in communication with a number of vehicles C1, C2, and data is generated by the vehicles C1, C2 when they are participating in traffic activity. The data transmitted by the vehicles C1, C2 to the central computer includes at least one time stamp as well as coordinates of the vehicle. The same are transmitted, optionally together with additional data detected by sensors of the vehicle C1, C2, in a traffic status message VZN from each vehicle to the central computer ZR. As additional information in a traffic status message VZN, data detected by, for example, assistance systems of the vehicle C1, C2, can be transmitted to the central computer. Such data may be detected by, for example, an ABS, ASR, ESP, or rain sensing system, etc. of each vehicle C1, C2 and processed in a corresponding assistance system.

The transmission of the traffic status message VZN from any vehicle C1, C2 to the central computer ZR is preferably carried out utilizing a mobile communications interface. This can be designed according to the GSM, UMTS, or GPRS standard, for example. As such, each transmission of a traffic status message accrues a cost to the electronic data transmission service provider.

In principle, a traffic status message VZN is transmitted by the vehicles C1, C2 participating in the traffic activity to the central computer ZR in prespecified intervals and/or upon the appearance of a detected, prespecified event, such as the beginning or end of a traffic jam, for example. The central computer ZR produces a message N from the received traffic status message and optionally from the data detected by stationary sensors, said message containing traffic data VD and a confidence parameter CL which represents a measure for the reliability of the traffic data contained in the message N. The transmission of the message N can either be carried out by a broadcast method or by utilizing the already named mobile communications interface.

Using the traffic data VD contained in a message N, a computer R1, R2 in any vehicle C1, C2 can identify a derived action with regard to the current location and a selected route. Typically, a computer R1, R2 checks the received traffic data VD for plausibility. This means that the selected route is checked and the current location is verified using satellite navigation data. If the problem described in the traffic data lies on the currently identified route, an alternative route can be identified and relayed via an output device (audio and/or video system of the vehicle). In this case, the computer only makes use of the traffic data which is relevant for the vehicle.

Moreover, the computer R1, R2 of a vehicle C1, C2 evaluates the confidence parameter CL contained in the message N. According to the magnitude of the confidence parameter CL, the transmission of a traffic status message VZN, which also has at least one time stamp as well as coordinates of the vehicle, is directed to the central computer. In this case, the computer R1, R2 checks concretely whether the confidence parameter contained in the message exceeds a prespecified threshold value. The transmission of the traffic status message to the central computer is suppressed if the confidence parameter exceeds the prespecified threshold value.

In contrast, if the confidence parameter CL is less than the prespecified threshold value, the traffic status message VZN is transmitted to the central computer ZR. In this way, the transmission of the traffic status message in prespecified intervals, described above, is controlled by a vehicle C1, C2 according to the magnitude of the confidence parameter CL. A traffic event detected by the central computer ZR as certain is identified, for example, with a high confidence parameter. Subsequently, traffic status messages which relate to this traffic event are no longer sent to the central computer ZR by corresponding vehicles C1, C2. In this way, the number of traffic status messages transmitted to the central computer by the vehicles C1, C2 can be drastically reduced. Relatedly, costs associated with the transmission are reduced.

The message N containing the traffic data VD is repeated by the central computer ZR in regular intervals, e.g. every five minutes, until a given traffic event is no longer valid. The possibility exists for the computer to reevaluate the measure of the reliability of the traffic data VD via the confidence parameter CL with each new transmission of the message N. In this way, the central computer ZR can control, in a simple manner, whether or not it would like to receive new traffic status data from the vehicles C1, C2 for a certain traffic event.

In addition to the information provided by the vehicles C1, C2, additional information can be incorporated into the measure for the reliability of the traffic data, such additional information being provided by, for example, cameras, induction coils, network knowledge, etc. In an area equipped with such stationary sensors, it is therefore in some circumstances not even necessary for the vehicles C1, C2 to provide traffic status information for the evaluation of the traffic situation, since such data can be detected exclusively by means of the stationary sensors. This can be controlled by means of the corresponding magnitude of the confidence parameter.

The messages N transmitted by the central computer ZR to the vehicles C1, C2 are preferably constructed according to a protocol of the TPEG TAP standard. This protocol already includes a field for the confidence parameter (the so-called "Confidence level"), which can be used for the method according to the invention. The field provided in this standard is intended to give information to a computer for route planning in a vehicle. Using the information contained in this field, a new calculation of the route can be performed based on disruptions of traffic appearing in the route. It is therefore reasonable in this context that the threshold value, which influences the transmission or suppression of a traffic status message, lies above an additional threshold value of the confidence parameter, wherein the additional threshold value is used for deciding whether a modification of the route planning for the vehicle must be undertaken. While the additional threshold value typically lies in the range of 60%, it is reasonable if the threshold relevant to the invention is greater than 70%, particularly greater than 75%, and preferably greater than 80%.

Figure 2:
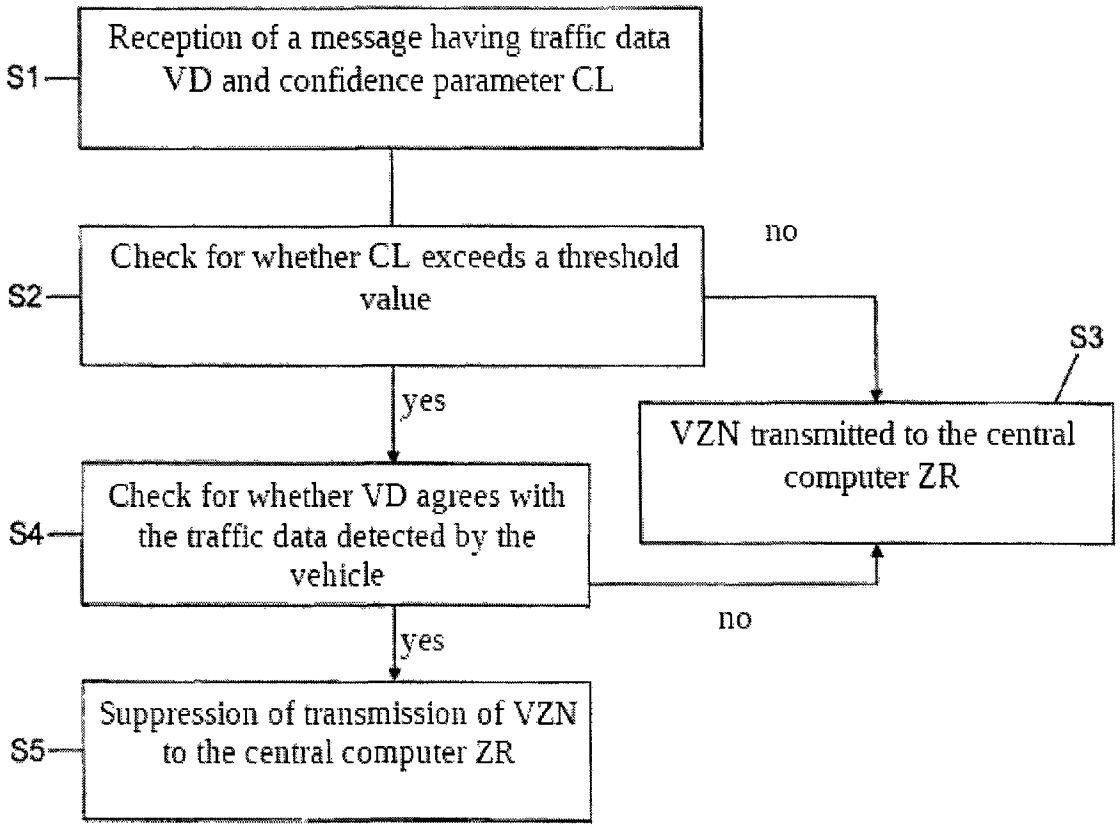

FIG. 2 shows the process flow of the method according to the invention in a schematic illustration. In a first step S2, a vehicle computer receives a message having traffic data VD and a confidence parameter CL. In a second step S2, a check is carried out to determine if the confidence parameter CL exceeds a threshold value. If this is not the case, then a traffic status message VZN is transmitted to the central computer ZR in a third step S3. If the confidence parameter CL exceeds the threshold value, then a check is carried out in a fourth step S4 to determine whether the traffic data VD agrees with traffic data detected by the vehicle. In this case, it is sufficient if a simply qualitative evaluation of the traffic data of the vehicle takes place. If such a divergence between the traffic data VD contained in the message, and the traffic data detected by the vehicle cannot be detected, then a transmission of a traffic status message VZN to the central computer ZR is suppressed in a fifth step S5. In the opposing case, i.e. if a difference is detected, the traffic status message VZN is transmitted to the central computer.

The method according to the invention enables a dynamic modification of the transmission behavior for traffic status messages. As such, the transmission can be carried out independently for each traffic event. Particularly, very short reaction times can be achieved. Because a minimal number of traffic status messages are transmitted by vehicles to the central computer, it is possible to save significant transmission costs when using a mobile communications interface. The invention consequently allows optimization of the transmission behavior and costs by only necessitating the transmission of required information to the central computer.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for the operation of a driver assistance system of a vehicle, comprising the acts of:

receiving, by a computer of the vehicle, a message sent by a central computer, the message containing traffic data and a confidence parameter which represents a measure for the reliability of the traffic data; and transmitting a traffic status message, including a time stamp and coordinates of the vehicle, to the central computer, based upon the value of the confidence parameter;

wherein the computer checks whether the confidence parameter contained in the message exceeds a prespecified threshold value, wherein the transmission of the traffic status message to the central computer is suppressed if the confidence parameter exceeds the prespecified threshold value, and wherein the traffic status message is transmitted to the central computer if the confidence parameter is less than the prespecified threshold value.

2. The method according to claim 1, wherein the computer of the vehicle compares the traffic data contained in the message to the traffic data detected by the computer of the vehicle, and if a difference is identified, the traffic status message is transmitted to the central computer, independently of whether the confidence parameter exceeds the prespecified threshold value or not.

3. The method according to claim 1, wherein the message sent by the central computer is received by a receiving unit of the vehicle, the receiving unit being designed to receive broadcast messages.

4. The method according to claim 1, wherein the message sent by the central computer is received by a receiving unit of the vehicle, the unit being designed to receive mobile communications messages.

5. The method according to claim 1, wherein the message sent by the central computer is constructed according to a protocol of the TPEG TAP standard.

6. The method according to claim 1, wherein the prespecified threshold value lies above an additional threshold value of the confidence parameter, and the additional threshold value is used to decide whether a modification must be carried out for the route planning for the vehicle.

7. The method according to claim 1, wherein the threshold is greater than 80%.

8. The method according to claim 1, wherein the confidence parameter is a flag.

9. The method according to claim 1, wherein the traffic status message is transmitted via a mobile communications interface to the central computer.

10. A non-transitory computer-readable medium encoded with a computer program, which can be loaded directly into the internal memory of a digital computer of a vehicle and has software code segments which can be used to carry out the steps according to claim 1 when the computer program runs on the computer of the vehicle.

11. A method for operation of a communication infrastructure for detecting and producing road traffic data, comprising the acts of:

sending, by a vehicle participating in road traffic, a traffic status message including a time stamp and coordinates of the vehicle to a central computer in prespecified intervals or upon occurrence of a detected, prespecified event;

producing, by the central computer, a message from the received traffic status message, said message having traffic data and a confidence parameter which represents a measure for the reliability of the traffic data, and transmitting said message to the vehicle;

receiving, by a computer of the vehicle, the message produced by the central computer including the traffic data and the confidence parameter; and transmitting the traffic status message by the vehicle to the central computer, based upon the magnitude of the confidence parameter;

wherein the computer of the vehicle checks whether the confidence parameter contained in the message exceeds a prespecified threshold value, and if the confidence parameter exceeds the prespecified threshold value, the transmission of the traffic status message to the central computer is suppressed, and if the confidence parameter is less than the prespecified threshold value, the traffic status message is transmitted to the central computer.

12. The method according to claim 11, wherein the computer of the vehicle compares the traffic data contained in the message with traffic data detected by the computer of the vehicle, and if a difference is identified, the traffic status message is transmitted to the central computer, independently of whether the confidence parameter exceeds the prespecified threshold value or not.

13. The method according to claim 11, wherein the central computer broadcasts the message using a broadcast method.

14. The method according to claim 11, wherein the central computer transmits the message to the vehicle as a dedicated mobile communications message.

15. The method according to claim 11, wherein the central computer transmits the message according to a protocol of the TPEG TAP standard.

16. The method according to claim 11, wherein the central computer transmits the message in periodic intervals to the vehicle, and the confidence parameter is adjusted each time to the reliability of the traffic data.

17. A computer of a driver assistance system of a vehicle, comprising:

a receiving unit for receiving a message produced by a central computer, the message having traffic data and a confidence parameter which represents a measure for the reliability of the traffic data; and a control unit for directing the transmission of a traffic status message, having at least one time stamp and coordinates of the vehicle, to the central computer according to a magnitude of the confidence parameter;

wherein the computer checks whether the confidence parameter contained in the message exceeds a prespecified threshold value, wherein the transmission of the traffic status message to the central computer is suppressed if the confidence parameter exceeds the prespecified threshold value, and wherein the traffic status message is transmitted to the central computer if the confidence parameter is less than the prespecified threshold value.

18. The computer according to claim 17, which is further designed for carrying out a method for operation of a driver assistance system of a vehicle, comprising the acts of:

receiving, by the computer of the vehicle, the message sent by the central computer; and transmitting the traffic status message, including the at least one time stamp and coordinates of the vehicle, to the central computer, based upon the magnitude of the confidence parameter.

* * * * *